US008276890B1

(12) United States Patent
Kloehn

(10) Patent No.: US 8,276,890 B1
(45) Date of Patent: Oct. 2, 2012

(54) PRESSURE MONITORING PANEL FOR AERATION BASINS

(76) Inventor: Gerald Kloehn, New Berlin, WI (US)

( * ) Notice: Subject to any disclaimer, the term of this patent is extended or adjusted under 35 U.S.C. 154(b) by 0 days.

(21) Appl. No.: 13/362,872

(22) Filed: Jan. 31, 2012

(51) Int. Cl.
*B01F 3/04* (2006.01)

(52) U.S. Cl. ..... 261/127; 261/129; 261/135; 261/122.1

(58) Field of Classification Search ..... 261/127, 261/129, 135, 136, 122.1, 124, DIG. 70
See application file for complete search history.

(56) References Cited

U.S. PATENT DOCUMENTS

| | | | | |
|---|---|---|---|---|
| 4,330,385 | A | 5/1982 | Arthur et al. | |
| 4,382,867 | A | 5/1983 | Schmit et al. | |
| 4,737,275 | A | 4/1988 | Franks | |
| RE33,177 | E * | 3/1990 | Schmit et al. | 210/754 |
| 5,348,650 | A * | 9/1994 | Cummings, Jr. | 210/199 |
| 5,597,491 | A * | 1/1997 | Winkler | 210/754 |
| 6,200,468 | B1 | 3/2001 | Schmit | |
| 6,475,395 | B1 | 11/2002 | Schmit et al. | |
| 6,478,964 | B1 * | 11/2002 | Redmon | 210/620 |
| 6,720,882 | B2 | 4/2004 | Davey | |
| 6,843,470 | B2 * | 1/2005 | Okajima et al. | 261/65 |
| 6,973,375 | B2 | 12/2005 | Brodeur et al. | |
| 7,539,548 | B2 | 5/2009 | Dhawan | |
| 7,770,592 | B2 | 8/2010 | Knight et al. | |
| 2005/0126993 | A1 | 6/2005 | Johnson et al. | |
| 2005/0189275 | A1 | 9/2005 | Stewart | |
| 2010/0024816 | A1 * | 2/2010 | Weinstein et al. | 128/203.27 |

* cited by examiner

*Primary Examiner* — Charles Bushey
(74) *Attorney, Agent, or Firm* — Absolute Technology Law Group, LLC

(57) ABSTRACT

The present invention is a pressure monitoring panel apparatus with a panel housing that contains a programmable logic controller. Pressure transducers transmit the pressures from an aeration basin diffuser head and an aeration basin airline to a programmable logic controller. The programmable logic controller uses the pressures from the aeration basin diffuser head and aeration basin airline to determine the airflow rate through the aeration basin diffuser and the pressure drop across the aeration basin diffuser. Those values are then displayed on a viewable interface.

11 Claims, 4 Drawing Sheets

PRESSURE MONITORING PANEL FOR AERATION BASINS

FIELD OF INVENTION

The present invention relates to the field of wastewater treatment, and more specifically to an aeration basin diffuser pressure sensor.

BACKGROUND

Figure 1:
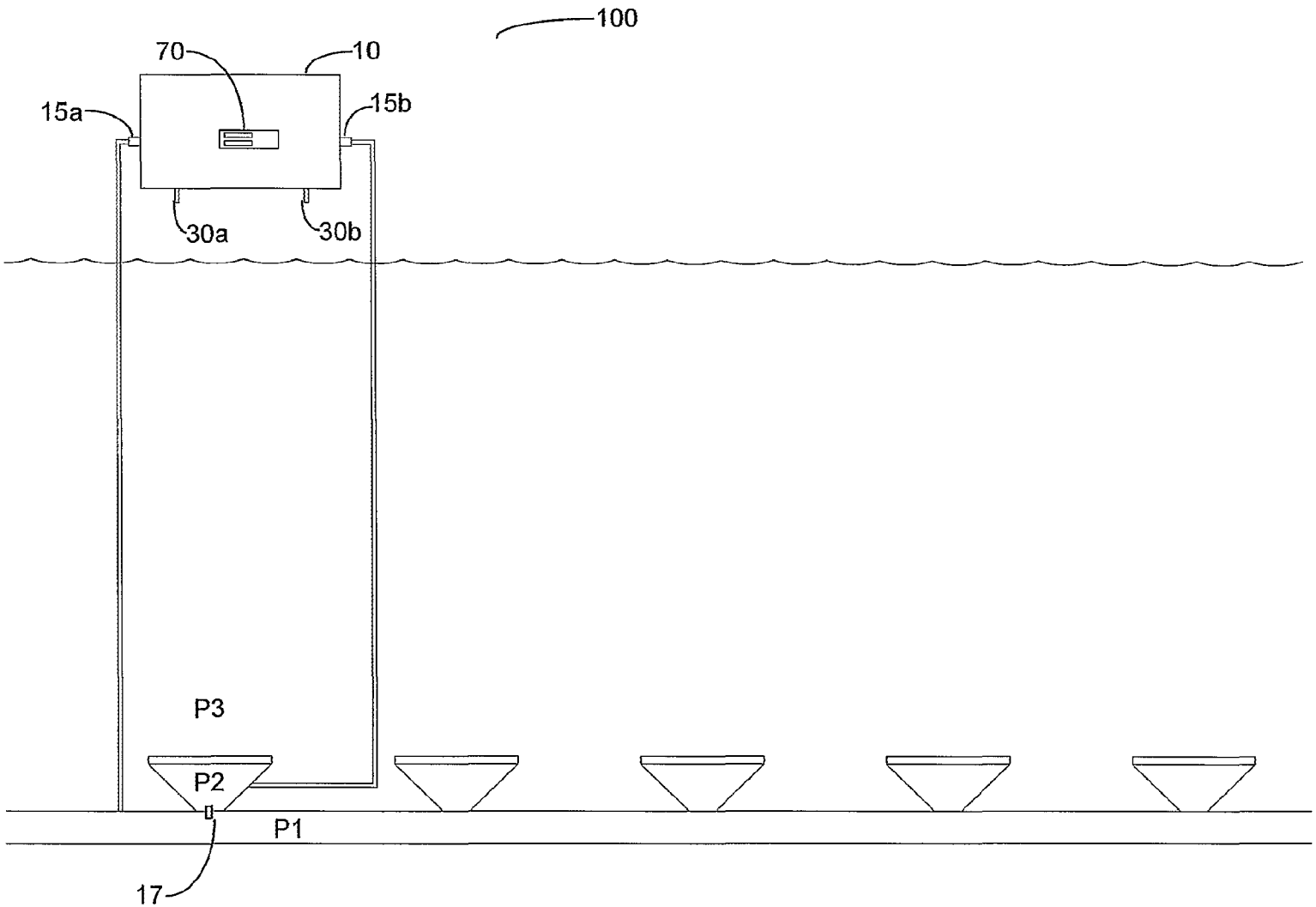
FIG. 1 is a system diagram of an exemplary embodiment of a pressure monitoring panel system.

Most wastewater treatment plants use aeration basins in the treatment process. In an aeration basin, diffusers add oxygen to the water because the bacteria that feed on and break down the organic material need oxygen. When oxygen levels in the wastewater decrease, the bacteria stop feeding on and metabolizing the organic matter. As the diffusers become blocked with waste material, less oxygen is aerated into the wastewater, and the bacteria are less productive. Diffusers must be cleaned in order to maintain bacteria activity.

Aeration basin diffusers must be cleaned manually through a long and sometimes expensive process. Ceramic systems must be cleaned with gas, acid or hydrogen chloride. For rubber systems, the entire system must be shut down and the built-up waste product scraped from the diffusers. Further, aeration basins may contain hundreds of diffusers, and a single wastewater treatment plant may have hundreds to thousands of diffusers in all basins. Both the materials and labor make cleaning the diffusers a costly task, especially if done before it is necessary.

A problem with current aeration basin diffuser systems is the inability to tell when diffusers require cleaning. A very small increase in dynamic wet pressure across a diffuser indicates a diffuser may need to be cleaned; however, current devices used to read changes in dynamic wet pressure and indicate the need for diffuser cleaning have failed to properly indicate and continuously monitor pressure across diffusers.

For example, U.S. Pat. No. 6,200,468 describes a pressure reading system used to determine when diffusers require cleaning. The system comprises a portable panel, which must be stored when not in use, and two pressure gages. One pressure gauge measures the dynamic wet pressure of the diffuser, while the second pressure gauge measures the pressure drop through the orifice. The system operator then uses a chart to determine the air flow rate and whether or not the diffusers need cleaning.

One problem known with this current panel system is its portability. It is cumbersome to set up, and the panel components are regularly damaged from the constant assembly, disassembly and improper storage. Further, operators often neglect to take regular readings because of the setup involved with the current panel system. Operators occasionally fail to take readings for great periods of time, resulting in decreased bacteria function and increased power consumption.

In addition, the panels fail to operate properly over time. For example, lines plug and gauges fail. Both improper handling and the panel's construction as a portably system make the lines and gauges vulnerable to inoperability. The lines and gauges are also exposed to the contaminated wastewater, which requires the panel system to be cleaned and maintained regularly.

The current system also requires an operator to interpret the results. Inexperienced, hurried or otherwise distracted operators may mistakenly determine the diffusers do not need to be cleaned when, in actuality, the wastewater basin does not contain sufficient aeration for the bacteria to metabolize.

SUMMARY OF THE INVENTION

The present invention is a system which includes pressure monitoring structural components panel that may be connected to existing pressure pipes, and which can quickly and accurately provide a digital reading of orifice pressure and dynamic wet pressure. The system performs digital readings utilizing novel structural connections and placements on existing pressure pipes. Various embodiments may include the ability to wirelessly transmit data to remote locations. Still other embodiments the system may incorporate functional and structural features which allow the pressure monitoring panel to be permanently mounted to diffusers.

The present invention is a pressure monitoring panel apparatus with a panel housing that contains a programmable logic controller. The programmable logic controller reads pressures from an aeration basin diffuser head and aeration basin airline in order determine the airflow rate through the aeration basin diffuser and the pressure drop across the aeration basin diffuser. Those values are then displayed on a viewable interface.

Glossary

As used herein, the term "air flow reading" is a value which represents the air flow in cubic feet per minute across or through one diffuser.

As used herein, the term "differential pressure" refers to the pressure difference between two points.

As used herein, the term "diffuser" refers to the portion of an aeration basin where air is introduced to the wastewater.

As used herein, the term "dynamic wet pressure" means the pressure drop across a diffuser. Dynamic wet pressure is calculated by taking the value of P2 and subtracting P3.

As used herein, the term "grid" means any structure within an aeration tank which includes at least one air supply line (or drop leg) and at least one-diffuser.

As used herein, the term "orifice" refers to an aperture in an aeration basin airline.

As used herein, the term "orifice pressure drop" means a pressure change which may be expressed by the calculation P1−P2.

As used herein, the term "P1" refers to the pressure in an air line.

As used herein, the term "P2" refers to the diffuser pressure or the pressure in an aeration basin diffuser head.

As used herein, the term "P3" refers to the pressure in an aeration basin as measured at the surface of a diffuser head.

DETAILED DESCRIPTION OF INVENTION

For the purpose of promoting an understanding of the present invention, references are made in the text to exemplary embodiments of a pressure monitoring panel system, only some of which are described herein. It should be understood that no limitations on the scope of the invention are intended by describing these exemplary embodiments. One of ordinary skill in the art will readily appreciate that alternate but functionally equivalent components and materials may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 is an exemplary embodiment of a pressure monitoring panel system 100. In the exemplary embodiment shown, aeration basin airline orifice has a pressure of P1 and carries air to be released by diffuser head, with a pressure of P2, into wastewater with a pressure of P3. The pressure of the wastewater P3 should be a fixed value for a given aeration basin. Pressure line with a pressure of P1 is exposed to airline orifice and connected to panel 10 by connector 15*a*. Pressure line with a pressure of P2 is connected to panel 10 by connector 15*b*. Panel 10 also contains display interface 70 and creates a housing around panel's interior components. Also shown in FIG. 1 are drains 30*a*, 30*b*.

FIG. 1 further illustrates the location of orifice 17.

In the exemplary embodiment shown, display interface 70 is on the exterior of panel 10. In further embodiments, display interface 70 may include a protective shield or may be located inside panel 10 so that a user must open panel 10 in order to view display interface 70.

Figure 2:
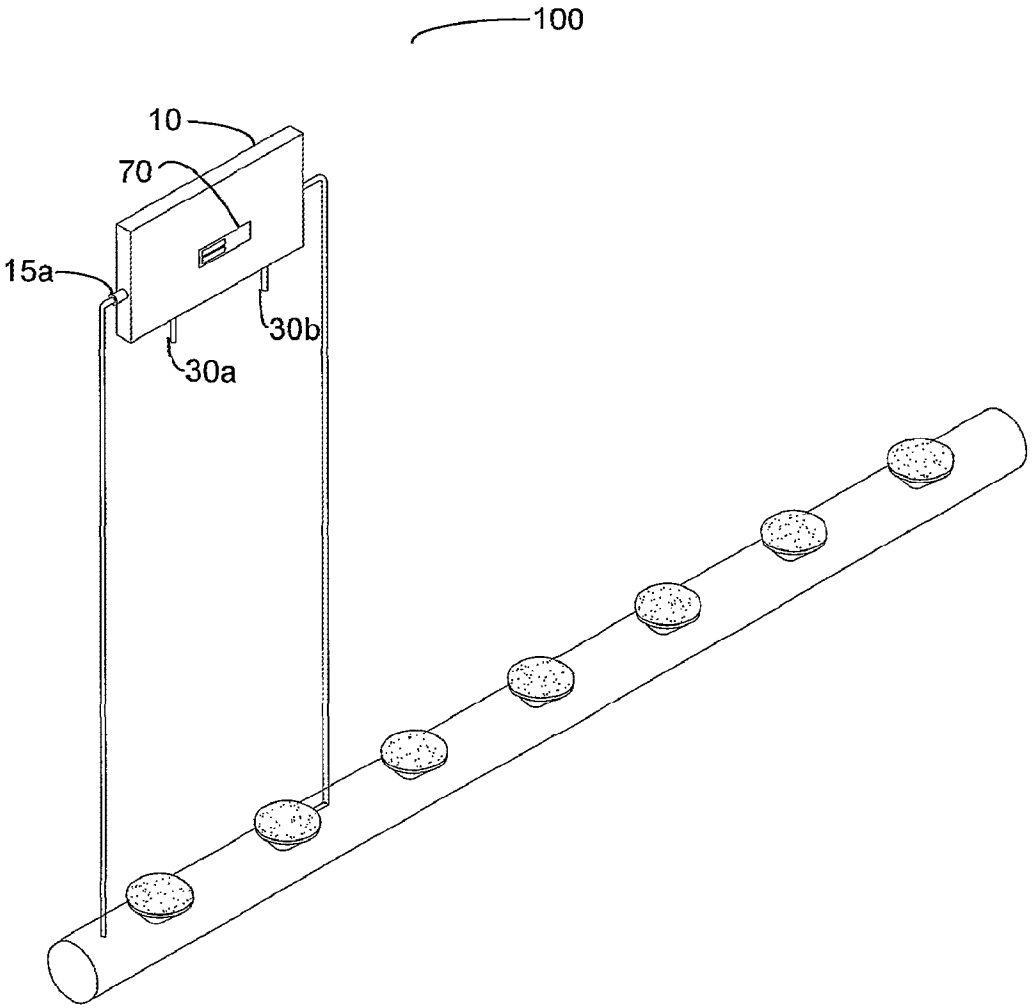
FIG. 2 is a top view of an exemplary embodiment of a pressure monitoring panel system.

FIG. 2 is a top view of an exemplary embodiment of a pressure monitoring panel system 100 for a single grid, showing display interface 70 on panel 10. Drains 30*a*, 30*b* and connectors 15*a*, 15*b* are also visible.

Figure 3:
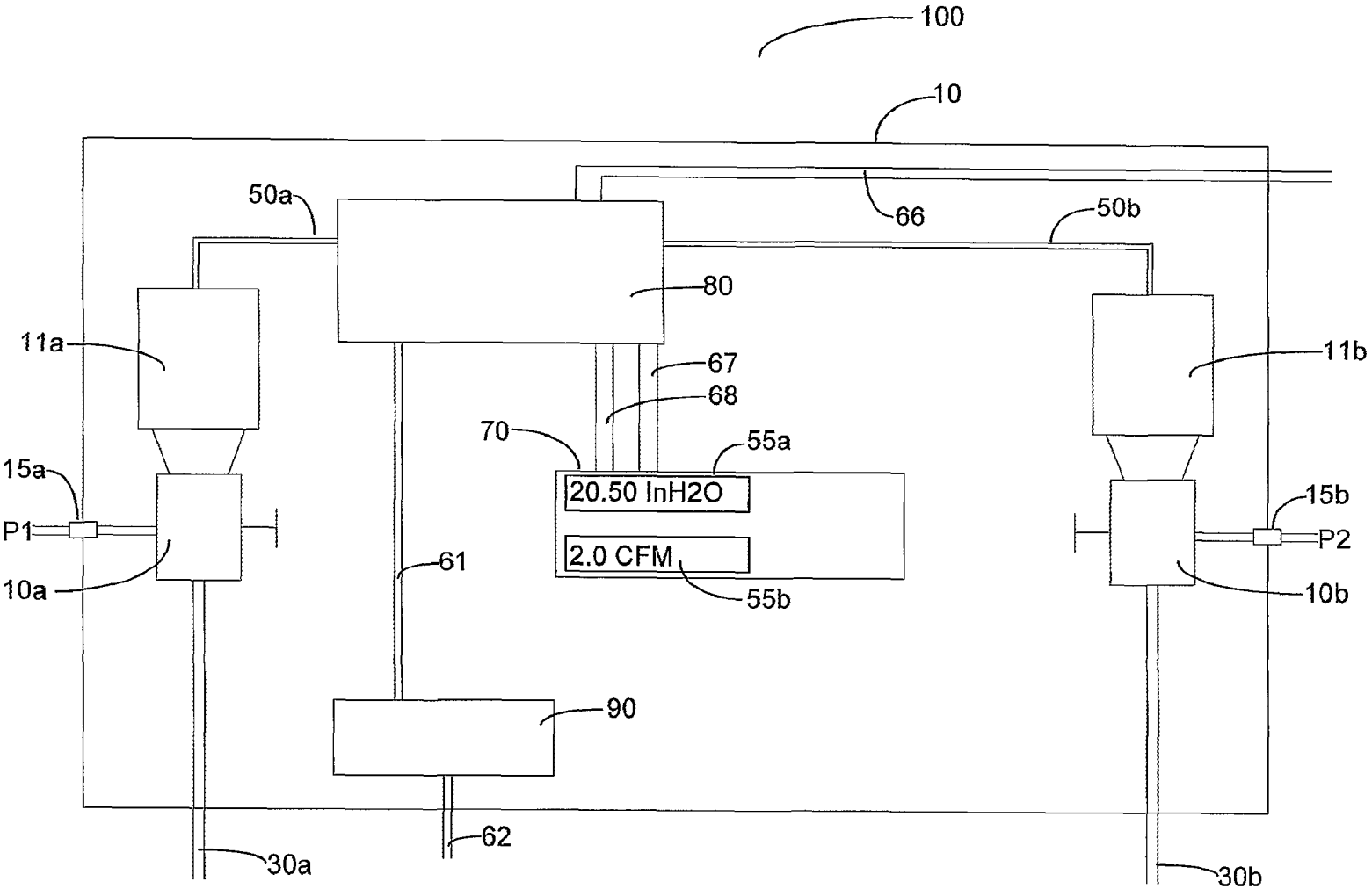
FIG. 3 illustrates the interior of an exemplary embodiment of a panel for a pressure monitoring panel system.

FIG. 3 illustrates the interior components of panel 10. Lines with pressures P1 and P2 enter panel 10 at opposite sides, passing through connectors 15*a*, 15*b*, and join three-way valves 10*a*, 10*b*. Three-way valves 10*a*, 10*b* are used to clean any water out of lines with pressures P1 and P2 before readings are taken, with the separated liquid draining through drains 30*a*, 30*b*. In the exemplary embodiment shown in FIG. 3, three-way valves 10*a*, 10*b* are standard three-way ball valves known in the art, but in further exemplary embodiments may be any structure known in the art to separate liquid from a gas. Three-way valves may also be manually opened and closed or the process may be automated. In still further embodiments, panel 10 may be equipped with a heater to prevent water from freezing lines with pressures P1, P2, connectors 15*a*, 15*b* and three-way valves 10*a*, 10*b*.

In the exemplary embodiment shown in FIG. 3, connectors 15*a*, 15*b* are adapted to fit existing pipes, requiring no modification to current aeration basins. In other embodiments, aeration basins may be specifically built to accommodate pressure monitoring panel system 100, requiring different or no connectors. In still further exemplary embodiments, connectors may be specific to a panel and require additional adapters to connect to existing lines.

After liquid has been separated out by three-way valves 10*a*, 10*b*, pressure transducers 11*a*, 11*b* convert pressures P1 and P2 into an electronic signal. Pressure transducer 11*a* measures the pressure in the basin airline which is released into the diffuser and pressure transducer 11*b* is a sensor which measures the pressure in the diffuser head. The electronic signal is transmitted by lines 50*a*, 50*b* to programmable logic controller 80. Programmable logic controller 80 calculates the pressure drop across diffuser based on the diffuser pressure P2 and the input value of water depth. The water depth is measured from the surface of the water to diffuser. Water depth will vary from site to site, but should be consistent at a given location and therefore only be a one-time field input. Programmable logic controller transmits this value by line 67 to display interface 70 to be displayed on viewing pane 55*a* as inches of water column. Programmable logic controller also calculates the air flow through diffuser by using the differential pressure value between aeration line orifice with a pressure of P1 and diffuser holder pressure P2, which is called the orifice pressure drop. Programmable logic controller transmits this value by line 68 to display interface 70 to be displayed on viewing pane 55*b* in cubic feet per minute. Line 66 takes the data processed by programmable logic controller and transfers it to a centralized data collection system, such as an industrial control system with supervisory control and data acquisition. In still further embodiments, display interface 70 may be located at the centralized data collection system.

In the exemplary embodiment shown, pressure transducers 11*a*, 11*b* are standard pressure transducers known in the art, such as those sold by Dwyer, product number 628CR-08-GH-PI-EI-SI, with a 4-20 ma output. In still other embodiments, pressure transducers may be any device known in the art to convert a pressure reading into a signal which may be used in calculating orifice pressure drop and pressure drop across aeration basin diffusers.

In the embodiment shown, readings are displayed on display interface 70 in standard units. In further embodiments, display interface 70 may include options to change the display units. For example, display interface 70 may allow a user to change display and output units to metric units of measurement.

In the exemplary embodiment shown in FIG. 3, panel 10 is powered by power supply 90 which receives input power through input power line 62. In the exemplary embodiment shown, input power line 62 provides 110 V/1 Ph/60 Hz power. In other exemplary embodiments, panel 10 may be powered by an internal supply, such as a battery, or adapted to receive different input power. In yet further embodiments, panel 10 may include a power converter. In still further embodiments, panel 10 may include a solar panel to power panel 10 or provide supplemental power. Power line 61 runs power from power supply 90 to programmable logic controller 80.

In further exemplary embodiments, panel 10 may include a power switch to turn power to panel 10 on and off. In other exemplary embodiments, power switch may be adapted to allow a user to select a power input from an external power supply, an internal power supply, or a solar panel.

In still further exemplary embodiments, panel 10 may also include a temperature sensor. Temperature sensors may monitor the temperature of the aeration basin, the diffuser holder, and/or airline. Temperature readings may be used to compensate for changes in airflow circulation.

Figure 4:
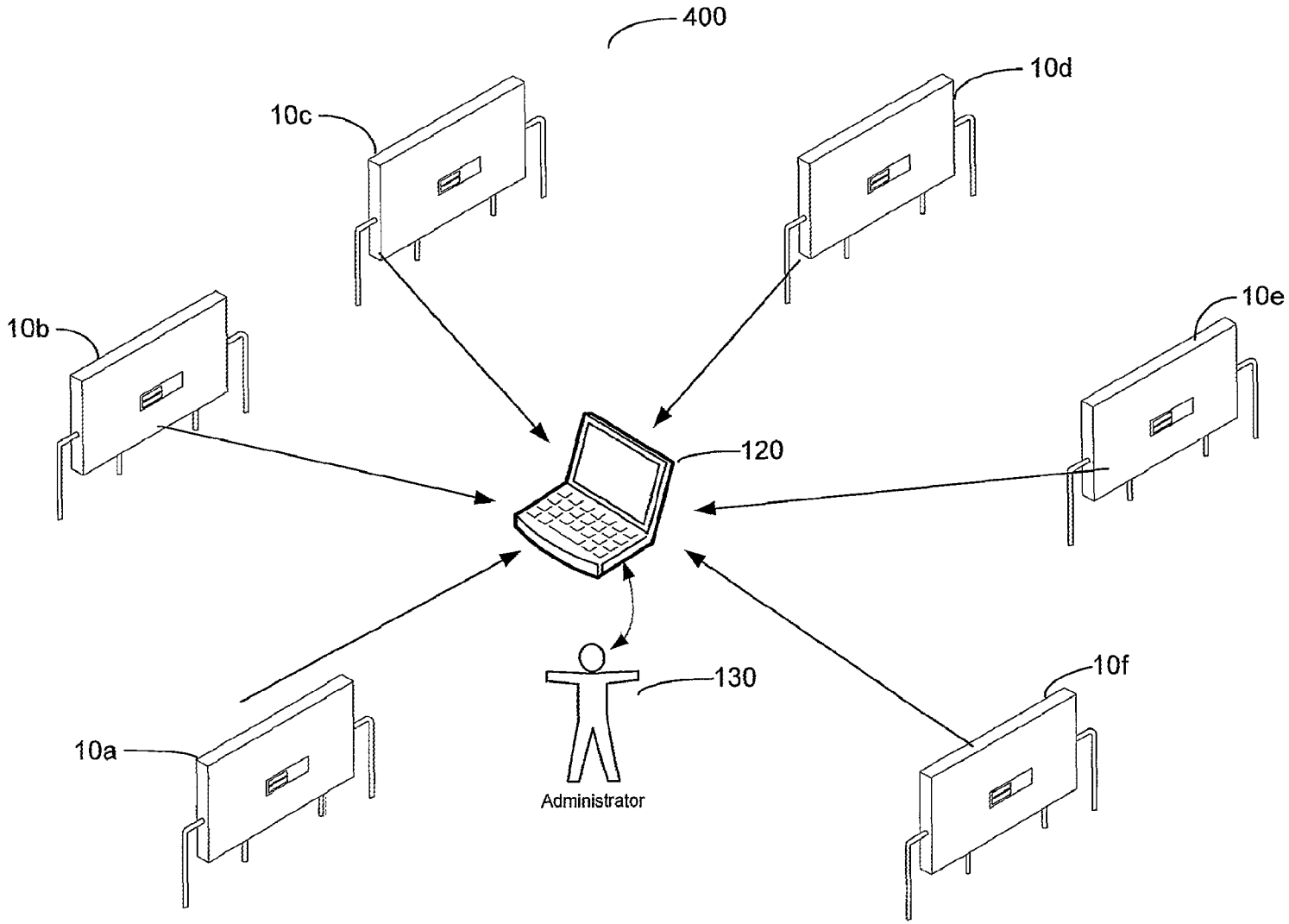
FIG. 4 illustrates a pressure monitoring panel system where information from multiple panels is wirelessly transmitted to an interface.

FIG. 4 illustrates a pressure monitoring panel system 400 where information from multiple panels 10*a*, 10*b*, 10*c*, 10*d*, 10*e*, 10*f* is wirelessly transmitted to processor 120. In the exemplary embodiment shown, panels 10*a*, 10*b*, 10*c*, 10*d*, 10*e*, 10*f* also include a wireless transmitter adapted to transmit data collected by panels 10*a*, 10*b*, 10*c*, 10*d*, 10*e*, 10*f* to processor 120. In the embodiment shown, processor 120 includes a user interface, allowing administrator 130 to control the input data and make any necessary adjustments. Various embodiments may contain more or fewer panels.

What is claimed is:

1. A self-monitoring aeration system comprised of:

at least one grid comprised of a plurality of diffusers through which a non-gaseous substance is passed enclosed within at least one aeration tank, wherein said aeration tank holds a quantity of water forming a water surface;

at least one panel housing located above the water surface of said at least one aeration tank;

at least one viewable digital interface containing no gauges corresponding to said at least one grid, said at least one digital interface mounted to said at least one surface of said panel housing;

at least one processor capable of receiving a user-input value which represents water depth, said at least processor being further configured to calculate the pressure value necessary to overcome a submergence pressure value which is proportional to the depth of the water;

a maximum of two pressure lines functionally coupled with said at least one diffuser, including a first pressure line used solely to measure header pressure at which air is entering at least one diffuser, and a second pressure line which includes a diffuser pressure sensor used solely to measure pressure across a diffuser to arrive at a diffuser pressure value and which further transmits said diffuser pressure value to said at least one processor;

said at least one processor further configured with software to calculate the difference between said submergence pressure value and said diffuser pressure value to arrive at a dynamic wet pressure, and to display said dynamic wet pressure on a user interface without the use of gauges.

2. The apparatus of claim 1 which further includes at least two transducers to measure an air flow rate through said aeration basin diffuser and an interface component to display said air flow rate on said viewable digital interface.

3. The apparatus of claim 2 which further includes at least two three-way valves, one of said three-way valves attached to each of said first pressure line and said second pressure line before said first and second transducers.

4. The apparatus of claim 1 which further includes at least two physical connectors adapted to connect said first and second pressure lines through said housing.

5. The apparatus of claim 1 which further includes connecting material adapted to connect said first and second pressure lines through said housing.

6. The apparatus of claim 1 which further includes a power source selected from the group consisting of a battery, a solar panel, an exterior power supply, and a power converter.

7. The apparatus of claim 2 which further includes a visual indicator having an indicator light, wherein said processor compares said dynamic wet pressure and said air flow rate to determine whether an aeration diffuser needs cleaning and turns said indicator light on when said diffuser needs cleaning.

8. The apparatus of claim 1 which further includes a power switch.

9. The apparatus of claim 1 wherein said panel is further adapted to display values in metric units.

10. The apparatus of claim 1 wherein said panel further includes a heater.

11. The apparatus of claim 1 which further includes at least one temperature sensor.

* * * * *